US009456645B2

(12) United States Patent
Ghazaly et al.

(10) Patent No.: US 9,456,645 B2
(45) Date of Patent: Oct. 4, 2016

(54) ABRASION RESISTANT GLOVE

(75) Inventors: Hafsah binti Mohd Ghazaly, Barnet (GB); Kwee Feng Hin, Selangor (MY); Norman Washington Keane, Selangor (MY)

(73) Assignee: Ansell Healthcare Products LLC, Iselin, NJ (US)

( * ) Notice: Subject to any disclaimer, the term of this patent is extended or adjusted under 35 U.S.C. 154(b) by 396 days.

(21) Appl. No.: 14/113,706

(22) PCT Filed: Apr. 26, 2012

(86) PCT No.: PCT/US2012/035228
§ 371 (c)(1),
(2), (4) Date: Dec. 18, 2013

(87) PCT Pub. No.: WO2012/149172
PCT Pub. Date: Nov. 1, 2012

(65) Prior Publication Data

US 2014/0109290 A1 Apr. 24, 2014

Related U.S. Application Data

(60) Provisional application No. 61/480,841, filed on Apr. 29, 2011.

(51) Int. Cl.
*A41D 19/015* (2006.01)

(52) U.S. Cl.
CPC ..... *A41D 19/01505* (2013.01)

(58) Field of Classification Search
CPC ..... A41D 2600/20; A41D 2600/202; A41D 19/0055; A41D 19/0058; A41D 19/01505; A41D 19/01564; A41D 19/0051; A41D 19/0062; A41D 13/087
USPC ..... 2/159, 161.3, 161.7, 161.8, 161.6
See application file for complete search history.

(56) References Cited

U.S. PATENT DOCUMENTS

| | | | | |
|---|---|---|---|---|
| 5,598,582 | A * | 2/1997 | Andrews | A41D 19/01505 2/16 |
| 5,822,791 | A * | 10/1998 | Baris | A41D 19/0065 112/16 |
| 6,080,474 | A | 6/2000 | Oakley et al. | |
| 6,210,798 | B1 | 4/2001 | Sandor et al. | |
| 7,112,621 | B2 | 9/2006 | Rohrbaugh et al. | |
| 2002/0073474 | A1* | 6/2002 | Geng | A41D 19/01529 2/16 |
| 2007/0204381 | A1 | 9/2007 | Thompson et al. | |
| 2009/0007313 | A1 | 1/2009 | Boorsma et al. | |

(Continued)

FOREIGN PATENT DOCUMENTS

| | | |
|---|---|---|
| GB | 2353960 A | 3/2001 |
| RU | 2343807 C2 | 1/2009 |

OTHER PUBLICATIONS

International Search Report and Written Opinion dated Jul. 26, 2012 for Application PCT/US2012/035228.

*Primary Examiner* — Gloria Hale
(74) *Attorney, Agent, or Firm* — Moser Taboada

(57) ABSTRACT

A glove comprising an elastomeric coating with a particle filler and a method of making such a glove. Specifically, the glove comprises a knitted liner formed from at least one yarn; a elastomeric coating covering at least a portion of the knitted liner; and wherein the elastomeric coating comprises a filler particle having a hardness greater than the hardness of the elastomeric coating.

19 Claims, 2 Drawing Sheets

(56) References Cited

U.S. PATENT DOCUMENTS

2009/0106876 A1 4/2009 Yeung
2009/0139011 A1* 6/2009 VanErmen ..... A41D 19/01505 2/161.8
2013/0125283 A1 5/2013 Henssen et al.
2013/0139294 A1* 6/2013 Zetune ..... A41D 19/01505 2/163
2014/0000006 A1* 1/2014 Perera ..... A41D 19/01505 2/167

* cited by examiner

ABRASION RESISTANT GLOVE

Embodiments of the present invention generally relate to gloves. More specifically, embodiments of the invention relate to abrasion resistant gloves.

Knitted gloves are commonly used in handling and light assembly conditions. To provide additional protection and enable knitted gloves to find use in more demanding application, advances in glove manufacturing technologies have resulted in the partial coating of a knitted liner with an adherent latex layer so that the glove is breathable in the exposed knitted areas, yet has a protective barrier in the latex coated area. To be flexible and comfortable, the latex coating is relatively thin. However, during use, thinly coated gloves wear out in the areas that receive the most friction, such as the finger tips and the palm.

Therefore, there is a need in the art for a thin, lightweight, flexible knitted glove that is coated with an elastomeric coating having improved wear resistant properties.

SUMMARY OF THE INVENTION

Embodiments of the present invention generally relate to a glove comprising an elastomeric coating with a particle filler and a method of making such a glove. Specifically, the glove can comprise a knitted liner formed from at least one yarn; a elastomeric coating covering at least a portion of the knitted liner; and wherein the elastomeric coating comprises a filler particle having a hardness greater than the hardness of the elastomeric coating.

Provided is a glove, comprising: a knitted liner comprising yarn; a elastomeric coating covering at least a portion of the knitted liner; and wherein the elastomeric coating comprises a filler particle having a hardness greater than the hardness of the elastomeric coating, the particles effective to increase the cut resistance of the elastomeric coating. The filler particles can have a Mohs hardness value of 3 Mohs or more. The filler particles can have a diameter of 0.1 to 10 microns. The elastomeric coating can contain 10 phr of hard particles or more. The glove can have an average Gurley stiffness number of 48 mgf or less, or an average Clark stiffness number of approximately 5 cm or less. The glove, at an elastomer coated surface, can have an EN cut resistance Index of 2 or higher, and an average Gurley Stiffness or average Clark stiffness number within about 10% of the value of a comparable glove without filler particle.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

While the invention is described herein by way of example using several embodiments and illustrative drawings, those skilled in the art will recognize that the invention is not limited to the embodiments of drawing or drawings described. It should be understood that the drawings and detailed description thereto are not intended to limit the invention to the particular form disclosed, but on the contrary, the invention is to cover all modification, equivalents and alternatives falling within the spirit and scope of the present invention as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to. The word "glove" means glove or glove liner.

DETAILED DESCRIPTION

Figure 1A:
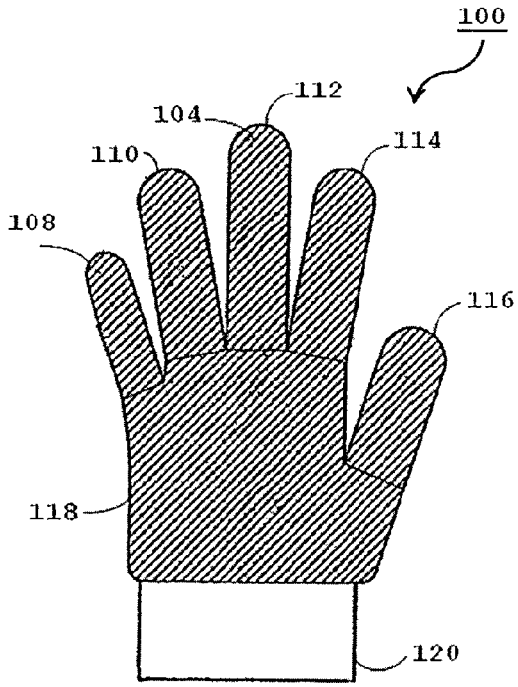
FIG. 1A illustrates a palm-side view of a right hand abrasion resistant glove according to an embodiment of the present invention.
Figure 1B:
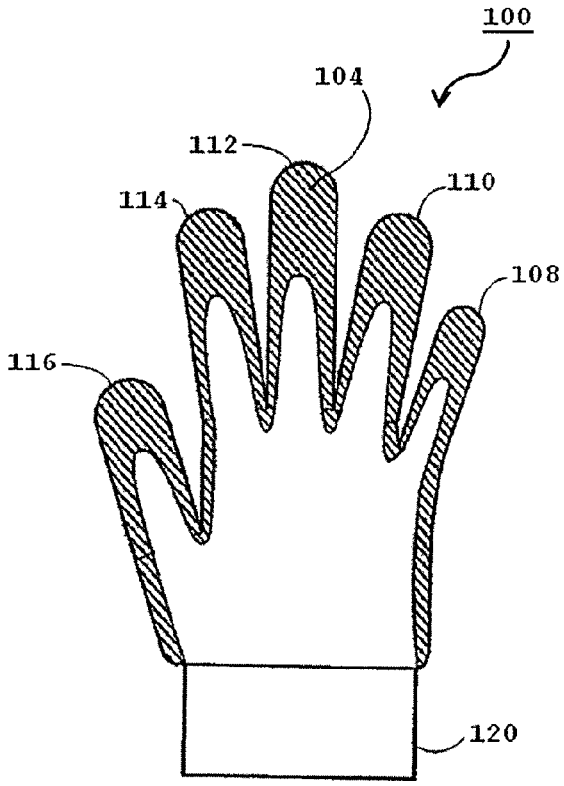
FIG. 1B illustrates a knuckle-side view of a right hand abrasion resistant glove according to an embodiment of the present invention.

Embodiments of the present invention comprise an abrasion resistant glove comprising an elastomeric coating with a particle filler. FIG. 1A depicts a palm-side view of right hand abrasion resistant glove 100 according to one embodiment of the present invention. FIG. 1B depicts a knuckle-side view of a right hand abrasion resistant glove 100 according to one embodiment of the present invention.

The abrasion resistant glove 100 includes a knitted liner 102; an elastomeric coating 104 adhered to the knitted liner 102, and filler particles 106 within the elastomeric coating 104. In one embodiment, the abrasion resistant glove 100 is comprised of four finger components 108 (pinky), 110 (ring), 112 (middle), 114 (index), a thumb component 116, a palm component 118, and a wrist component 120. In one embodiment, the elastomeric coating 104 substantially covers the palm side of the four finger components 108, 110, 112, 114, the thumb component 116, and the palm component 118, leaving the wrist component 120 uncovered by the elastomeric coating 104. In one embodiment, only a portion of the finger components 108, 110, 112, 114, the thumb component 116, and the palm component 118 of the knuckle-side are covered by the elastomeric coating 104, whereas the wrist component 120 of the knuckle side is not covered with the elastomeric coating 104.

In one embodiment, between 10% and 40% of each finger component 108, 110, 112, 114, and the thumb component 116, including the tips are covered by the elastomeric coating 104 on the knuckle side. In an alternative embodiment, between 15% and 25% of each finger component 108, 110, 112, 114, and the thumb component 116, including the tips, are covered by the elastomeric coating 104 on the knuckle side.

Figure 2:
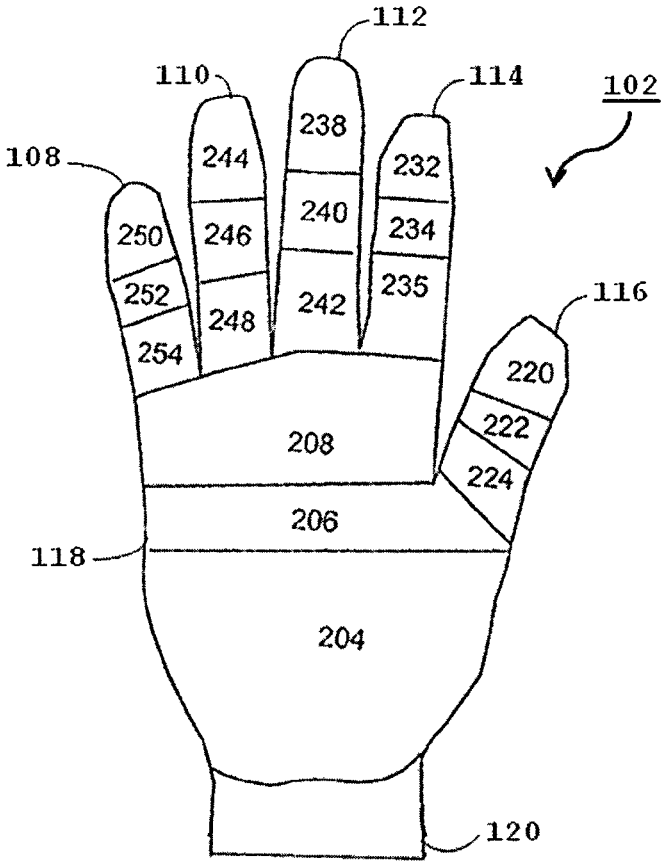
FIG. 2 illustrates a knitted liner according to an embodiment of the present invention.

FIG. 2 depicts the knitted liner 102. The knitted liner 102 can be considered with respect to nineteen sections, including three sections for each of the finger components 108, 110, 112, 114, and the thumb 116 of the glove, three sections 204, 206, and 208 for the palm component 118 and one wrist section 120. In one embodiment, each of the components, such as finger components 108, 110, 112, 114 and the thumb component 116, can be knit according to separate instructions for the knitting machine to create distinct sections designed to conform to the shape and/or operation of the fingers. Illustrative three sections are shown in FIG. 2 as sections 250, 252, and 254 for the pinky finger 108; sections 244, 246, and 248 for the ring finger 110; sections 238, 240 and 242 for the middle finger 112; sections 232, 234, and 235 for the forefinger 114; and sections 220, 222, and 224 for the thumb 116. The knitted liner 102 of this invention can be knit on a knitting machine and requires programming of the machine for each of the different (e.g., nineteen) sections. The knitted liner 102 may be configured in a manner described in commonly assigned U.S. Patent Application Publication Number 2009/0211305, filed Apr. 24, 2009 on behalf of Thompson, et al., incorporated herein by reference in its entirety.

The illustrated sections encompass the finger or hand, but other sections can be selected and programmed based on improving the fit of the glove over a uniformly stitched glove.

The elastomeric coating 104 includes filler particles 106 to improve the abrasion resistance and the cut resistance of the abrasion resistant glove 100. The elastomeric coating 104 may be natural rubber latex, synthetic rubber latex, or the like. The synthetic rubber latex may be selected, for example, from the group comprised of polychloroprene, carboxylated acrylonitril butadiene, polyisoprene, polyurethane, styrene-butadiene, and combinations thereof.

In some embodiments, the filler particles 106 mixed into the elastomeric coating 104 comprise, for example, boron carbide, boron nitride, and the like. In some embodiments, the filler particles used have a hardness value of at least 9 Mohs. In some embodiments, the filler particles have an average diameter of 0.1 to 10 microns. In some embodiments, the abrasion resistant glove 100 contains 15 parts per hundred rubbers (PHR) of filler particles, in some cases with in an average Gurley stiffness value of approximately 42.74 milligrams of force (mgf). Although the exemplary particles comprise boron carbide or boron nitride, other particles may be used. To provide abrasion resistance, the particles have a hardness that is greater than the hardness of the elastomeric coating.

The particles can have hardness values of 3 Mohs or higher, including 8 or 9 Mohs or higher. In certain embodiments, the filler particles are distributed uniformly throughout the elastomeric coating. In certain embodiments, the amount of filler particles is 10 PHR or higher, or 11 PHR or higher, or 12 PHR or higher, or 13 PHR or higher, or 14 PHR or higher, or 15 PHR or higher. In certain embodiments, the amount of filler particles is 20 PHR or lower.

In one embodiment, the elastomeric coating 104 is applied in a manner such that it covers at least a portion of the knitted liner 102 but does not penetrate the knitted liner 102 to contact the skin of the wearer. In certain embodiments, there is substantially no such penetration (any such penetrations are so insubstantial that they are not felt by most users). The elastomeric coating 104 can be applied by dipping the knitted liner 102 into the elastomeric coating 104 material, such as in the form of an aqueous polymeric latex emulsion, or by spraying the elastomeric coating 104 onto the knitted liner 102. In one embodiment, an aqueous dispersion of filler particles 106 is mixed with an aqueous polymeric latex emulsion, such that the filler particles 106 are distributed evenly throughout the mixture.

In one embodiment, the elastomeric coating 104 may have commonly used stabilizers such as potassium hydroxide, ammonia, sulfonates and the like. In one embodiment, the elastomeric coating 104 may contain other commonly used ingredients such as surfactants, anti-microbial agents, fillers/additives and the like. In one embodiment, the elastomeric coating 104 has a viscosity in the range of 2000-3000 centipoises.

Figure 3:
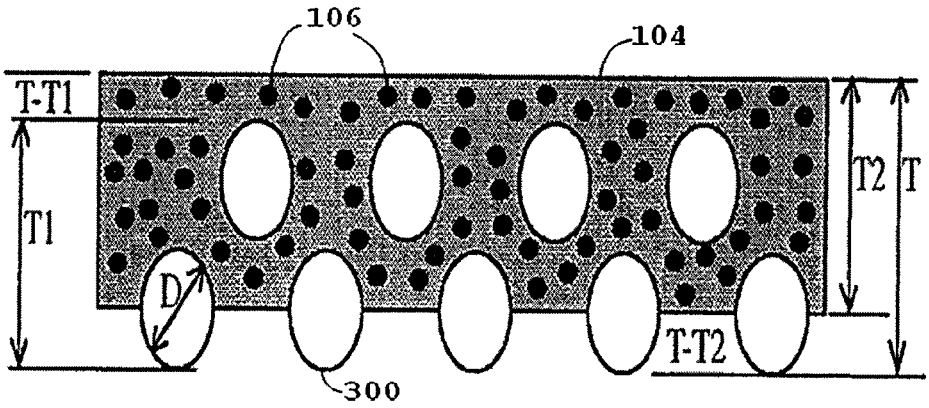
FIG. 3 illustrates a schematic representation of a knitted liner with an elastomeric coating penetrating halfway or more through the thickness of the knitted liner.

FIG. 3 illustrates schematically the arrangement of yarns 300 in the knitted liner 102 and its relationship to the elastomeric coating 104 containing filler particles 106, which may be foamed or unfoamed. The yarns 300, average diameter D, are knitted in the liner, producing a liner with a thickness T1. An elastomeric coating 104 of thickness T2 penetrates the knitted liner 102 producing an overall glove thickness. For at least a portion of the knitted liner 102, on average the distance defined by T−T2 is not penetrated by the elastomeric coating 104 and the degree of penetration is defined by the ratio (T−T2)/T1. If the elastomeric coating 104 penetrates the entire thickness of the liner 102, the unpenetrated region is zero regardless of the thickness T1 of the knitted liner 102. The elastomeric coating 104 that is present outside the liner 102 is given by T−T1. Therefore, T2, the thickness of the elastomeric coating 104, is generally in the range 0.75 to 1.25 of the thickness of the knitted liner T1 (for instance, on average). When the ratio is 0.75, the elastomeric coating 104 penetrates three quarters of the way into the liner 102 when the top of the elastomeric coating 104 is flush with the fibers 300. The penetration may be smaller, but in certain embodiments is still greater than half way, and results in the elastomeric coating extending above the top of the fibers 300. At the ratio of 1.25, the elastomeric coating 104, penetrating three quarter way, still has half the thickness of the elastomeric coating 104 outside the knitted liner 102. In this range, the geometry of FIG. 3 is accomplished with the elastomeric coating 104 covering the knitted liner 102, but not penetrating the entire thickness of the knitted liner 102.

In certain embodiments, the weight of the glove is in the range of 0.04 to 0.12 pounds.

The manufacturing process used in one embodiment of the present invention involves several steps. In some embodiments, an 18-gauge knitted liner with nominally 140 denier nylon 66 yarn is dressed on a hand shaped former (e.g., ceramic or metallic) and is immersed in a 2-10 wt % calcium nitrate aqueous solution. The calcium nitrate coagulant solution penetrates the entire thickness of the knitted liner. When this coagulant coated liner contacts an elastomeric coating, it destabilizes the emulsion and gels the latex. In one embodiment, the elastomeric coating is formed by mixing an aqueous polymeric latex emulsion with an aqueous dispersion of filler particles. The coagulant coated knitted liner dressed on the former is dipped in the elastomeric coating. The elastomer coated knitted liner is then washed and heated to form a cured glove. The cured glove is washed again to remove coagulant salts and other processing chemicals. In certain embodiments, the yarn has a denier in a range from approximately 70 to 221.

The method of creating a glove can comprise: coating a glove shaped knitted liner disposed on a hand shaped former with a coagulant solution; dipping the coagulant coated glove shaped knitted liner into an aqueous elastomeric coating composition comprising a dispersion of filler particles to form a elastomer coated glove shaped knitted liner; and curing the elastomer coated glove shaped knitted liner to form the glove. It can comprise additional optional steps, such as: creating a glove shaped knitted liner; placing the glove shaped knitted liner on a hand shaped former; dipping the glove shaped knitted liner in a coagulant solution; withdrawing the gloved shaped knitted liner from the coagulant solution to form a coagulant coated gloved shaped knitted liner; creating a aqueous dispersion using filler particles; mixing the aqueous dispersion with an aqueous latex emulsion to create an elastomeric coating; dipping the coagulant coated glove shaped knitted liner into a tank containing the elastomeric coating; withdrawing the glove shaped knitted liner from the tank containing the elastomeric coating to form a elastomer coated glove shaped knitted liner; washing the elastomer coated glove shaped knitted liner; heating the elastomer coated glove shaped knitted liner to form a cured glove; and washing the cured glove.

The flexibility of a glove is a strong function of the thickness of the glove and increases according to the inverse of the cube of the thickness. Thus, a reduction in the thickness of an elastic body, such as an elastomer coated glove, by 30 percent increases the flexibility by factor of 3. The thickness of the glove is made up of the thickness of the knitted liner and the thickness of the adherently bonded elastomeric coating.

However, reducing the thickness of the knitted liner generally requires the elastomeric coating to penetrate approximately halfway or more (e.g., on average), to create adhesion, between the elastomeric coating and the knitted liner. Two controllable process variables are available for precisely and reliably controlling the penetration of the elastomeric coating into the knitted liner, even when the knitted liner is relatively thin. These process variables are 1) the control of the elastomeric coating's viscosity and 2) the depth of immersion of the knitted liner dressed former into the aqueous elastomeric coating. The typical depth of immersion needed for the elastomeric coating to penetrate the knitted liner to a depth greater than half the thickness of the knitted liner but less than the entire thickness of the knitted liner is 0.8-1.0 cm, based on the viscosity of the elastomeric coating. Since an elastomeric coating is generally provided on the palm and finger areas of a glove, the former is articulated using a complex mechanism that moves the former in and out of the elastomeric coating emulsion, immersing various portions of the knitted liner dressed on the former to progressively varying depths. As a result, some portions of the glove may have some degree of elastomeric coating penetration, however, more than 75% of the knitted liner is penetrated at least half way or more than halfway without showing a elastomeric coating stain on the skin-contacting surface of the glove.

In another embodiment of the invention, the elastomeric coating containing particle filler is foamed using well-dispersed air cells in a range of 5 to 50 volumetric percent, forming closed cells or open cells with interconnected porosity in the elastomeric coating. Once the elastomeric coating is foamed with the right air content and the viscosity is adjusted, refinement of the foam is undertaken by using the right whipping impeller stirrer driven at an optimal speed first and the air bubble size is refined using a different impeller run at a reduced speed. This foamed elastomeric coating generally has a higher viscosity and therefore it is more difficult to penetrate the interstices between the yarns in the knitted liner and may require a higher depth of immersion of the former with the dressed knitted liner. The penetrated foamed elastomeric coating instantly gels due to the action of the coagulant resident on the surfaces of the yarns of the knitted liner, forming chocking regions between the fibers and preventing further entry of the foamed elastomeric coating into the thickness of the knitted liner. The air cells reduce the modulus of elasticity of the elastomeric coating, increasing the flexibility of the glove.

Air content in the range of 5-15 volumetric percentile results in foams that have closed cells. Closed cells provide a liquid proof elastomeric coating that is highly flexible, soft and spongy, and provides good dry and wet grip. Air content in the range of 15-50 volumetric percentile results in foams that have open cells. Open cells provide the glove breathability through the elastomeric coating. The elastomeric coating is breathable preventing the glove from becoming clammy. In one embodiment, an aqueous fluorochemical dispersion coating may be applied to the glove to prevent liquid from penetrating the foamed elastomeric coating due to the stretching of the open air cells. The aqueous fluorochemical dispersion comprises an aqueous solvent medium to form a coating that is typically 0.5 to 2 micron in thickness. The aqueous fluorochemical dispersion may also be applied to a glove with unfoamed elastomeric coating to prevent oil or water penetration through occasional imperfections in the elastomeric coating. Methods for incorporating high air contents are described in Woodford et al., U.S. Pat. No. 7,048,884, which is incorporated herein in its entirety.

A pinch force test measures the grip force required to lift a steel weight having a polished surface and covered or not with a mixture of hydraulic oil and grease.

A test bar with sensors inside that detects the grip force (units in kgf) is connected at one end by a cable that passes over and is suspended from an overhead pulley and then down to a bucket container on the floor. The bucket is filled with water to provide a certain load, e.g., of 2.5 kg, 4.5 kg or 6.5 kg. A tester wearing a glove specimen grasps a test bar to provide secure contact and grip so that a certain load (2.5 kg, 4.5 kg & 6.5 kg) can be lifted. The grip force applied on the test bar is then displayed, e.g., on the PD-100 Digital Indicator. The test bar and gloves are covered with water or oil when performing wet and oil grip test respectively.

TABLE

| Test Method |
|---|
| i) If an wet or oil test, 5 ml of water or oil (Shell Rimula X 15W-40 oil) is used to coat the glove specimen, and the coated glove specimen is rubbed on the test bar to wet or oil coat it.<br>a) A bucket is placed on a 30 kg balance and filled with tap water to provide the test weight (e.g., 6.5 kg).<br>b) The tester uses ideally the same hand to grasp the test bar wearing the test glove specimen. The tester grips the apparatus at right angles to the surfaces of the test bar using the thumb and the first finger (or second finger) only.<br>c) The gloved hand applies just sufficient grip force to the test bar to provide secure contact and grip so that with a downward movement of the tester's arm the weight could be lifted.<br>d) The grip force (in kgf) applied on the test bar is then displayed on the PD-100 Digital Indicator in two decimal places.<br>e) The test is repeated at a given load. |

With a 6.5 kg load, the average grip force dry is in certain embodiments 3 kgf or less. With the oil coating, the average is in certain embodiments 7 or less, or 6.5 or less, or 6 or less. In certain embodiments, these grip values are obtained with gloves having an average Gurley Stiffness of 48 mgf or less, or 47 or less, or 46 or less, or 45 or less, or 44 or less, or 43 or less, or an average Clark stiffness number of (approx.) 5 cm or less.

In certain embodiments, the gloves have an average Gurley Stiffness of 48 mgf or less, or 47 or less, or 46 or less, or 45 or less, or 44 or less, or 43 or less, or an average Clark stiffness number of (approx.) 5 cm or less.

Using the EN 388 test (Protective gloves against mechanical risks, September 2003) for EN abrasion resistance, the gloves in certain embodiments have an EN abrasion resistance of 8,000 cycles or greater.

Using the EN 388 test (September 2003) for EN cut resistance, the gloves, at their elastomer/particle coated surfaces, have an EN cut resistance Index of 2 or higher, or 2.5 or higher.

In certain embodiments, the gloves have one the above-recited cut resistances, and have an average Gurley Stiffness or average Clark stiffness number within about 10% of the value of a comparable glove with the same weight and pattern for added elastomer (the same elastomer) lacking the filler. In certain embodiments, the average Gurley Stiffness or Clark stiffness number is within about 5% of the comparable, or within about 2%. In certain embodiments, the gloves have one the above-recited cut resistances, and have an average Gurley Stiffness or average Clark stiffness number within about 10% of the value of a second comparable glove with the same pattern for added elastomer (the same elastomer) lacking the filler, with the thickness of elastomer equaling the thickness of the elastomer plus filler. In certain embodiments, the average Gurley Stiffness or Clark stiffness number is within about 5% of the second comparable, or within about 2%.

Although only a few exemplary embodiments of the present invention have been described in detail above, those skilled in the art will readily appreciate that many modifications are possible in the exemplary embodiments without materially departing from the novel teachings and advantages of this invention.

All ranges recited herein include ranges therebetween, and can be inclusive or exclusive of the endpoints. Optional included ranges are from integer values therebetween (or inclusive of one original endpoint), at the order of magnitude recited or the next smaller order of magnitude. For example, if the lower range value is 0.2, optional included endpoints can be 0.3, 0.4, . . . 1.1, 1.2, and the like, as well as 1, 2, 3 and the like; if the higher range is 8, optional included endpoints can be 7, 6, and the like, as well as 7.9, 7.8, and the like. One-sided boundaries, such as 3 or more, similarly include consistent boundaries (or ranges) starting at integer values at the recited order of magnitude or one lower. For example, 3 or more includes 4 or more, or 3.1 or more.

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority, such as U.S. Prov. Application 61/480,841, filed 29 Apr. 2011, is also incorporated by reference herein in the manner described above for publications and references.

The foregoing description of embodiments of the invention comprises a number of elements, devices, machines, components and/or assemblies that perform various functions as described. These elements, devices, machines, components and/or assemblies are exemplary implementations of means for performing their respectively described functions. While the foregoing is directed to embodiments of the present invention, other and further embodiments of the invention may be devised without departing from the basic scope thereof.

The invention claimed is:

1. A finished glove, comprising:

a knitted liner formed from at least one yarn; and, defining a finished glove, an elastomeric coating at least about ¾ covering and adhering to the palm, palm-side of the finger and finger tips of the knitted liner;

wherein the elastomeric coating comprises filler particles of a diameter of 0.1 to 10 microns and having a Mohs hardness of 8 Mohs or more, the particles effective to increase the cut resistance of the elastomeric coating, wherein the elastomeric coating contains 10 phr of hard particles or more, wherein the glove has an average Clark stiffness number of less than approximately 5 cm, and wherein the glove has EN cut resistance index of 2 or higher.

2. The glove of claim 1, wherein the filler particles are distributed uniformly throughout the elastomeric coating.

3. The glove of claim 1, wherein the glove has a Gurley stiffness number of 48 mgf or less.

4. The glove of claim 3, wherein the filler particles are boron carbide or boron nitride.

5. The glove of claim 1, wherein the elastomeric coating comprises a cured latex selected from the group consisting of natural latex, synthetic latex, and blends of natural and synthetic latex.

6. The glove of claim 5, wherein the synthetic latex is selected from the group comprised of polychloroprene, carboxylated acrylonitrile butadiene, polyisoprene, polyurethane, styrene-butadiene, and combinations thereof.

7. The glove of claim 1, wherein the at least one yarn has a denier in a range from approximately 70 to 221.

8. The glove of claim 1, wherein the weight of the glove is in the range of 0.04 to 0.12 pounds.

9. The glove of claim 8, wherein the filler particles are distributed uniformly throughout the elastomeric coating, and the elastomeric coating contains 12 phr of hard particles or more.

10. The glove of claim 9, wherein the glove has a Gurley stiffness number of 48 mgf or less.

11. A method of creating a finished glove of claim 1, comprising:

coating the glove shaped knitted liner disposed on a hand shaped former with a coagulant solution;

at least about ¾ dipping the coagulant coated glove shaped knitted liner into an aqueous elastomeric coating composition comprising a dispersion of filler particles of diameter of 0.1 to 10 microns to form a elastomer coated glove shaped knitted liner to form the elastomeric coating; and curing the elastomer coated glove shaped knitted liner to form the finished glove.

12. The method of claim 11, wherein the filler particles are boron carbide or boron nitride.

13. The method of claim 12, wherein the weight of the glove is in the range of 0.04 to 0.12 pounds.

14. The method of claim 13, wherein the elastomeric coating contains 12 phr of hard particles or more.

15. The method of claim 14, wherein the glove has a Gurley stiffness number of 48 mgf or less.

16. The glove of claim 1, wherein the filler particles are distributed uniformly throughout the elastomeric coating, and the elastomeric coating contains 15 or 20 phr of hard particles.

17. The glove of claim 16, wherein the elastomeric coating provides an about ¾ covering.

18. The glove of claim 1, wherein the elastomeric coating provides an about ¾ covering.

19. The glove of claim 1, wherein the filler particles have a Mohs hardness value of 9 Mohs or more.

* * * * *